United States Patent [19]

Nishikawa et al.

[11] 4,276,525

[45] Jun. 30, 1981

[54] COAXIAL RESONATOR WITH PROJECTING TERMINAL PORTION AND ELECTRICAL FILTER EMPLOYING A COAXIAL RESONATOR OF THAT TYPE

[75] Inventors: Toshio Nishikawa, Nagaokakyo; Sadahiro Tamura; Youhei Ishikawa, both of Kyoto, all of Japan

[73] Assignee: Murata Manufacturing Co., Ltd., Japan

[21] Appl. No.: 963,756

[22] Filed: Nov. 27, 1978

[30] Foreign Application Priority Data

| | | | |
|---|---|---|---|
| Dec. 14, 1977 | [JP] | Japan | 52-150949 |
| Dec. 14, 1977 | [JP] | Japan | 52-168921[U] |
| Jun. 22, 1978 | [JP] | Japan | 53-76037 |

[51] Int. Cl.[3] ..... H01P 1/205; H01P 7/08

[52] U.S. Cl. ..... 333/206; 333/207; 333/223

[58] Field of Search ..... 333/73 C, 73 S, 73 W, 333/73 R, 82 R, 83 R, 83 A, 98 R, 182, 202–212, 219, 222–235, 245

[56] References Cited

U.S. PATENT DOCUMENTS

| | | | |
|---|---|---|---|
| 2,597,897 | 5/1952 | Ostlund | 333/182 X |
| 2,983,855 | 5/1961 | Schlicke | 333/182 X |
| 3,408,599 | 10/1968 | Horton et al. | 333/73 R |
| 3,505,618 | 4/1970 | McKee | 333/73 R |
| 4,151,494 | 4/1979 | Nishikawa et al. | 333/206 X |

FOREIGN PATENT DOCUMENTS

| | | | |
|---|---|---|---|
| 2705245 | 9/1977 | Fed. Rep. of Germany | 333/73 R |
| 52-96844 | 8/1977 | Japan | 333/73 R |

*Primary Examiner*—Marvin L. Nussbaum

*Attorney, Agent, or Firm*—Ostrolenk, Faber, Gerb & Soffen

[57] ABSTRACT

The disclosure relates to an improved coaxial resonator and an electrical filter employing such coaxial resonators. The electrical filter includes a casing of electrically conductive material, at least more than one coaxial resonators, for example, ¼ wavelength coaxial TEM resonators each having dielectric member disposed between inner conductor and outer conductor of the coaxial resonator and a terminal electrode secured in the inner conductor to provide a terminal portion projecting from an open end face of each of the coaxial resonators, and accommodated in the casing so as to be electrically connected and mechanically secured to the casing, and coupling members for electrically coupling the resonators to each other at the terminal portions and also to input and output connectors for said electrical filter.

4 Claims, 13 Drawing Figures

COAXIAL RESONATOR WITH PROJECTING TERMINAL PORTION AND ELECTRICAL FILTER EMPLOYING A COAXIAL RESONATOR OF THAT TYPE

BACKGROUND OF THE INVENTION

The present invention relates to an electrical filter and more particularly, to an electrical filter employing coaxial resonators, for example, transverse electro-magnetic mode coaxial resonators (referred to as TEM coaxial resonators herein) which have improved designs especially advantageous from the viewpoint of manufacture.

Generally, electrical filters utilizing coaxial resonators have been widely used in electrical and electronic equipment operating, for example, in VHF and UHF ranges.

Referring to FIG. 1, there is shown one example of the structure of a conventional coaxial resonator currently in production. In FIG. 1, the known ¼ wavelength coaxial TEM resonator R generally comprises an inner conductor $E_1$, outer conductor $E_2$, and a dielectric member D of, for example, the titanium oxide group, filling the space between the inner conductor $E_1$ and outer conductor $E_2$. More specifically, the dielectric member D may have a cylindrical tube-like configuration having a thick wall, and, for example, silver paste which has a superior high frequency conductivity and good adhesion with respect to the dielectric material is applied to inner and outer wall surfaces of the dielectric member D by means of baking or like to form thereon the inner conductor $E_1$ and outer conductor $E_2$. Meanwhile, into the hollow interior of inner conductor $E_1$, a central rod d, composed of a material similar to that of the tubular dielectric member D and having the same length as dielectric member D may be inserted and secured there.

The known ¼ wavelength coaxial TEM resonator having the construction described above, however, has disadvantages with respect to connection with other electronic components, especially when it is to serve as part of a filter. More specifically, the open end of the resonator is normally connected to other components by means of capacitive coupling, and when capacitors are employed for such connections, it is necessary to take special measures for fixing the capacitors to the resonators. Moreover, it has been a general practice that the resonant frequency of a resonator of the above described type is adjusted by cutting the opposite faces of the resonator to alter its axial length, but such an adjustment cannot be efficiently made, particularly after the resonator is incorporated into a filter casing.

Meanwhile, regarding the electrical filters, there has been proposed, for example, in Japanese Open Patent Application No. 52-96844, an electrical filter employing coaxial TEM resonators as described in the foregoing mainly for the purpose of reducing the filter size, etc. in accord with the recent trend to miniaturization of electrical and electronic equipment, but the known electrical filter as described above still has some problems to be solved with respect to its performance, and with respect to the efficiency of its manufacture.

SUMMARY OF THE INVENTION

Accordingly, an essential object of the present invention is to provide a compact electrical filter for use in electrical and electronic equipment which is stable in functioning and simple in construction.

Another important object of the present invention is to provide an electrical filter of the above described type which will perform faithfully according to its design, with good reproducibility.

A further object of the present invention is to provide an improved coaxial resonator for use in an electrical filter of the above described type, the design of which facilitates connection with other parts and components, for use in compact electrical filters which shall be simple in construction and low in cost.

Yet a further object of the present invention is to provide an improved coaxial resonator of the above described type which is so arranged that the adjustment of its resonant frequency, especially after the resonator has been incorporated into a casing, is markedly facilitated.

In accomplishing these and other objects, according to the present invention, the electrical filter includes a casing of electrically conductive material, a plurality of coaxial resonators, e.g., ¼ wavelength coaxial TEM resonators each having a dielectric member disposed between an inner conductor and an outer conductor and being a terminal electrode secured to the inner conductor as a terminal projecting from an open end face of the coaxial resonator, and accommmodated in the casing, to which it is electrically and mechanically connected. Coupling members electrically couple the terminals of the resonators to each other and also to input and output connectors of the electrical filter. This arrangement yields a compact electrical filter that is simple in structure, performs faithfully according to the intention of its designer, and can be manufactured at low cost.

BRIEF DESCRIPTION OF THE DRAWINGS

These and other objects and features of the present invention will become apparent from the following description taken in conjunction with the preferred embodiment thereof with reference to the accompanying drawings in which.

Before the description of the present invention proceeds, it is to be noted that like parts are designated by like reference numerals throughout figures of the accompanying drawings.

DETAILED DESCRIPTION OF THE INVENTION

Figure 1:
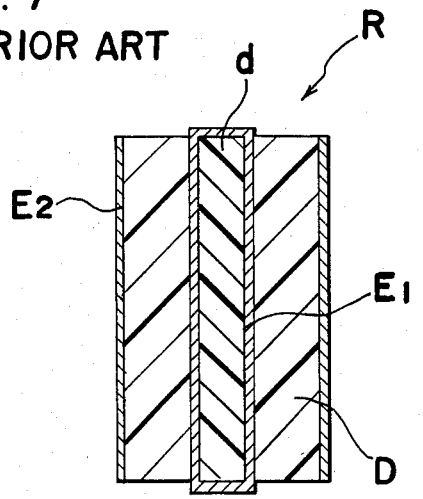
Fig. 1 PRIOR ART
FIG. 1 is a sectional view of a conventional ¼ wavelength coaxial TEM resonator, already referred to, FIG. 2 is a sectional view of a ¼ wavelength coaxial TEM resonator according to one preferred embodiment of the present invention.
Figure 2:
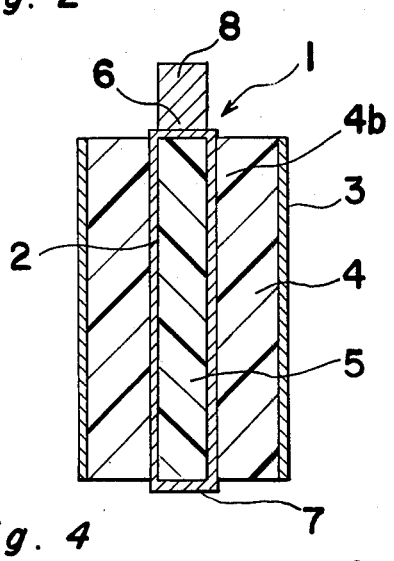

Referring now to the drawings, there is shown in FIG. 2 a ¼ wavelength coaxial TEM resonator 1 according to one preferred embodiment of the present invention which generally comprises an inner conductor 2, an outer conductor 3 and a dielectric member 4, for example, a ceramic dielectric member of the titanium oxide group filling the space between the inner and outer conductors 2 and 3. More specifically, the resonator 1 includes the cylindrical dielectric member 4 with an axial bore 4*b* made of dielectric material of, for example, the titanium oxide group; the inner cylindrical conductor 2 formed on the inner cylindrical surface of the dielectric member 4 by an electrode forming method such as baking onto it an electrode forming material with superior high frequency conductivity and good adhesion with respect to the material of the dielectric member 4, for example, silver paste or the like; and the outer cylindrical conductor 3 formed on the outer cylindrical surface of the dielectric member 4, also by baking silver paste onto it, or the like. The inner conductor 2, is provided with an axial bore into which is inserted, to be secured thereat, a terminal electrode member 5 comprising a central rod of a ceramic material or the like similar to that of the dielectric member 4 and having the same length as said member 4, while the central rod 5 has its opposite end faces respectively covered with electrode films 6 and 7 which are integrally formed with the inner conductor 2. A terminal member 8 is bonded to the electrode film 6 by suitable means. It is to be noted that the terminal member 8 may instead be bonded to the electrode film 7.

Figure 3:
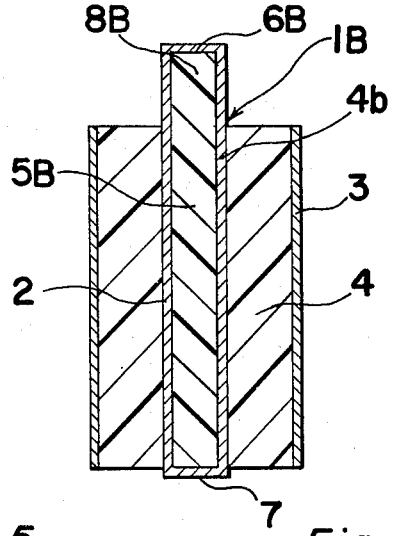
FIGS. 3 and 4 are views similar to FIG. 2, but particularly showing modifications thereof.

Referring to FIG. 3, there is shown a modification of the ¼ wavelength coaxial TEM resonator 1 of FIG. 2. In the modified resonator 1B of FIG. 3, the terminal member 8 described as employed in the resonator 1 of FIG. 2 is dispensed with, and the central rod 5B of dielectric material has a length longer than that of the dielectric member 4 so that it projects from one end of the resonator 4 to a predetermined extent, with the projecting end 8B of the central rod 5B serves as a terminal portion, being covered by the electrode film 6B integrally formed with the inner conductor 2. It is to be noted here that the entire central rod 5B may be replaced by a rod of metallic material.

Figure 4:
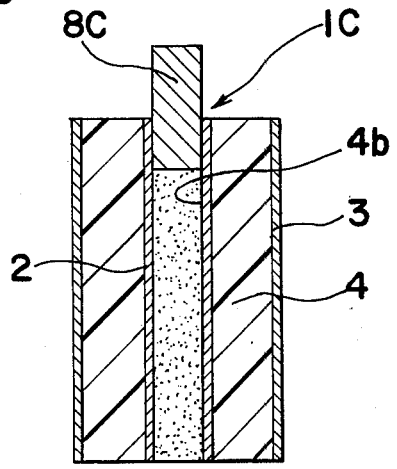

Referring to FIG. 4, there is shown another modification of the resonator of FIG. 2. In the modified resonator 1C of FIG. 4, the central rod 5 described as employed in the resonator 1 of FIG. 2 is dispensed with, and a terminal electrode 8C of any suitable configuration is inserted partway into the hollow interior of the inner conductor 2 and connected mechanically and electrically thereto. It should be noted that the terminal electrode 8C may be replaced by a dielectric member formed thereon with an electrode film (not shown).

Since other construction and effects of the modified resonators of FIGS. 3 and 4 are generally similar to those of the resonator of FIG. 2, detailed description thereof is abbreviated for brevity.

Figure 5:
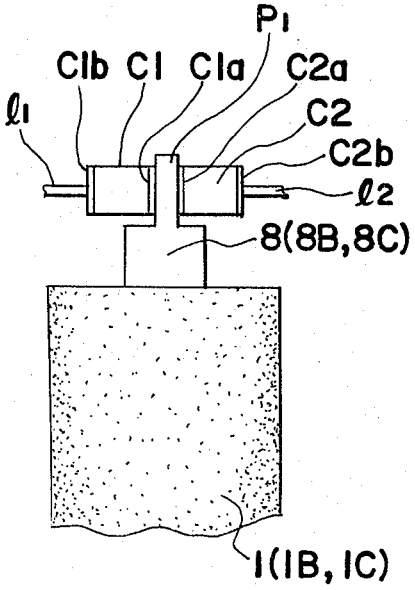
FIGS. 5 and 6 are fragmentary side elevational views of the ¼ wavelength coaxial TEM resonators of FIGS. 2 to 4, partly in section, particularly showing arrangements for mounting coupling capacitors on terminal electrodes of the resonators.
Figure 6:
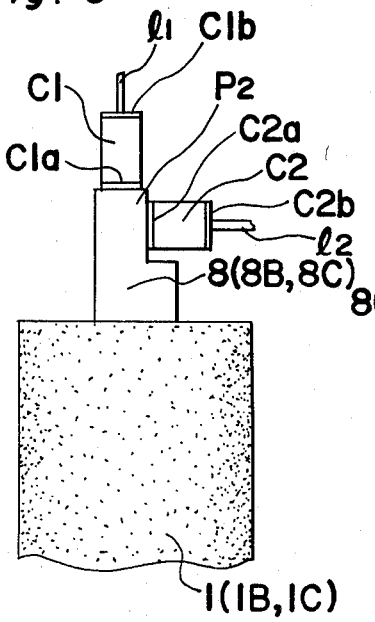

In FIGS. 5 and 6, there are shown arrangements for mounting coupling capacitors onto the terminal electrodes or terminal portions of the resonators 1, 1B or 1C of FIGS. 2 to 4. In the arrangement of FIG. 5, to mount chip-shaped capacitors $C_1$ and $C_2$ onto the resonator 1, 1B or 1C, for coupling the resonator with other resonators, connectors, etc. capacitively, the upper portion of the terminal electrode the 8, 8B or 8C is formed into a suitable shape, for example, a two-sided projection $P_1$ extending upwardly from the terminal electrode 8, 8B or 8C, and first electrodes C1*a* and C2*a* of the capacitors $C_1$ and $C_2$ are respectively connected to the opposite side faces of the projection $P_1$ by suitable means, while second electrodes C1*b* and C2*b* of the capacitors $C_1$ and $C_2$ are respectively connected to corresponding ends of lead wires $l_1$ and $l_2$ for connecting the resonator 1C to other resonators, connectors and the like at the other ends of the lead wires $l_1$ and $l_2$. In the modified mounting arrangement of FIG. 6, the terminal electrode, is formed into a shape different from that in FIG. 5 to have a one-sided projection $P_2$ at the upper portion of the terminal electrode 8, 8B or 8C. In this case, the first electrode C1*a* of the capacitor $C_1$ is connected to the upper surface of the projection $P_2$, while the first electrode C2*a* of the capacitor $C_2$ is connected to the side face of the projection $P_2$ as shown, and the second electrodes C1*b* and C2*b* of the capacitors $C_1$ and $C_2$ are connected to corresponding ends of the lead wires $l_1$ and $l_2$ for connecting the resonator to other resonators, connectors, etc. at the other ends of the lead wires $l_1$ and $l_2$.

Figure 7:
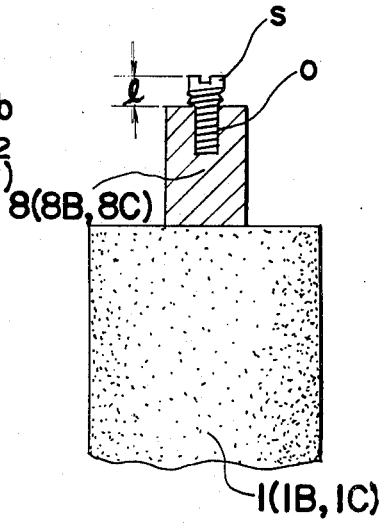
FIG. 7 is a view similar to FIGS. 5 and 6, but particularly showing a frequency adjusting structure which may be employed in the ¼ wavelength coaxial TEM resonators of the present invention.

Referring to FIG. 7, showing an arrangement for adjusting the resonant frequency of the resonator by the use of the terminal electrode or terminal portion 8, 8B or 8C, an electrically conductive male screw S is screwed into a threaded opening O coaxially formed in the terminal electrode 8, 8B or 8C for making it possible to adjust the amount of protrusion of the screw S which determines the resonant frequency of the resonator 1, 1B or 1C. It is needless to say that the capacitors $C_1$ and $C_2$ or other parts may be further mounted on the terminal electrode 8, 8B or 8C in the manner described with reference to FIGS. 5 and 6.

It is to be also noted that the resonant frequency may also be adjusted by cutting off part of the terminal electrode or terminal portion to alter the axial length thereof without employment of the screw S.

It should further be noted that although the present invention is chiefly described with reference to the ¼ wavelength coaxial TEM resonators, the concept of the present invention is not limited in its application to ¼ wavelength coaxial TEM resonators alone, but may readily be applied to resonators of other wavelengths, for example, to ½ wavelength coaxial TEM reasonators, etc.

As is seen from the foregoing description, according to the coaxial resonator of the present invention, not only is the connection thereof with other electrical and electronic parts readily effected, but the adjustment of the resonant frequency of the resonator is facilitated, and its structure is simplified, with consequent reduction in cost.

Figure 8:
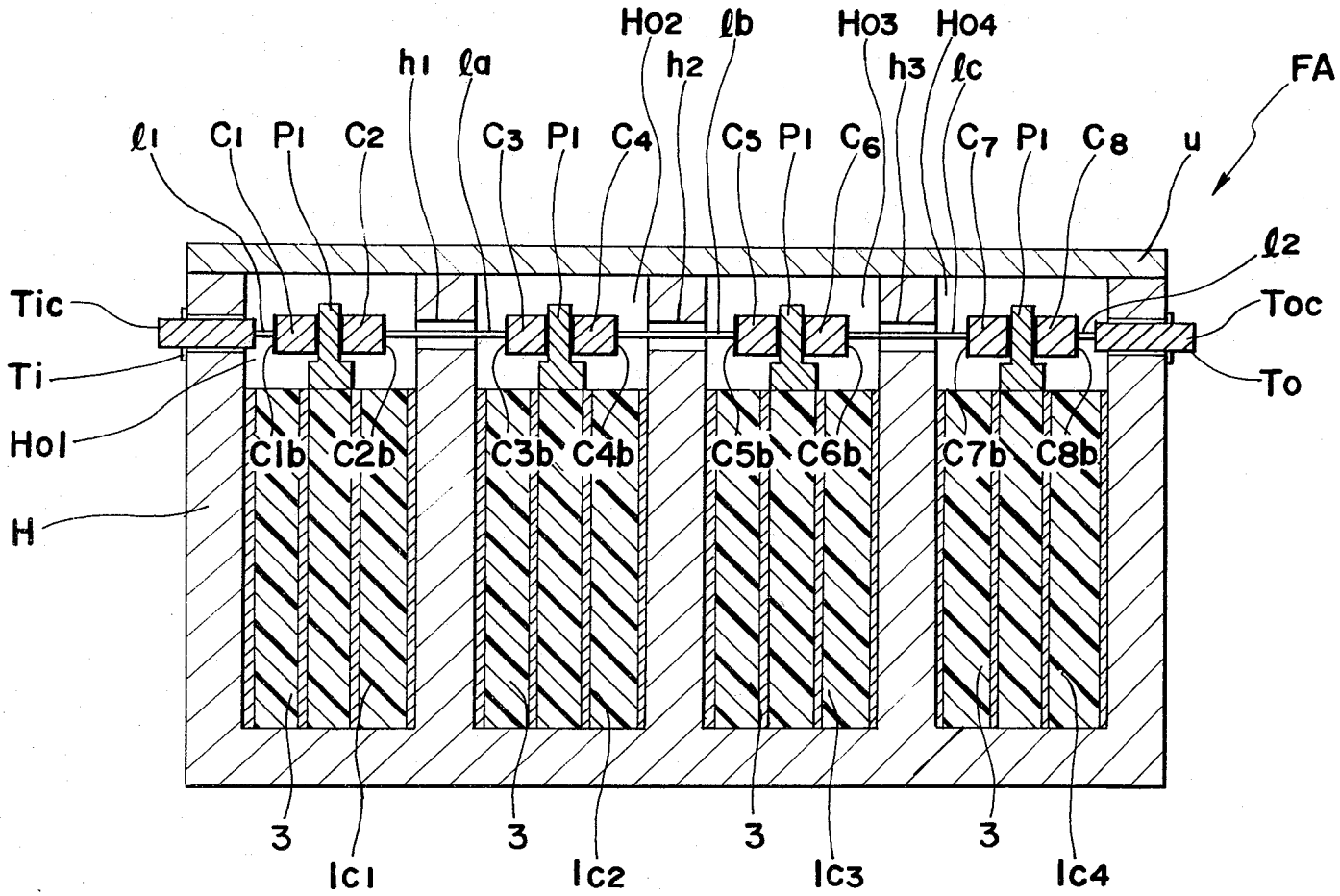
FIG. 8 is a side elevational view, partly in section, of an electrical filter according to one preferred embodiment of the present invention, employing the ¼ wavelength coaxial resonators of FIG. 5.

Referring now to FIG. 8, there is shown an electrical filter FA according to the present invention. The filter FA includes a casing H of electrically conductive material, for example, of duralumin having a cubic rectangular configuration and provided with vertical cavities Ho1, Ho2, Ho3 and Ho4 formed therein in laterally spaced and parallel relation to each other as shown in FIG. 8. In these cavities Ho1, Ho2, Ho3 and Ho4, there are respectively incorporated, for example, the ¼ wavelength coaxial TEM resonators $1C_1$, $1C_2$, $1C_3$ and $1C_4$ each having coupling capacitors $C_1$ and $C_2$ mounted thereon in the manner described with reference to FIG. 5. Each of the resonators $1C_1$, $1C_2$, $1C_3$ and $1C_4$ is fixed to the casing H, for example, with electrically conductive adhesive, for securing them and electrically connecting them to the casing H. Alternatively, the resonators $1C_1$ to $1C_4$ may be secured in the cavities Ho1 to Ho4 with securing screws (not shown). In the walls of the casing H between the cavities Ho1 and Ho2, between Ho2 and Ho3 and between Ho3 and Ho4 horizontal openings $h_1$, $h_2$ and $h_3$ are formed, through which the wire conductors la,lb and lc are passed to connect the respective capacitors $C_1$ through $C_8$ attached to resonators $1C_1$ to $1C_4$ each other.

More specifically, in FIG. 8, a central terminal Tic of an input coaxial connector Ti provided at the left side of the casing H is connected through the wire conductor l, to the second electrode C1*b* of the capacitor $C_1$ attached to the first resonator $1C_1$, while the second electrode C2*b* of the capacitor $C_2$ for the first resonator $1C_1$ is connected by the wire conductor la through the opening $h_1$ to the second electrode C1*b* of the capacitor $C_3$ attached to the second resonator $1C_2$. The second electrode C2*b* of the capacitor $C_4$ attached to the second resonator $1C_2$ is connected by the wire conductor lb through the opening $h_2$ to the second electrode C1*b* of the capacitor $C_5$ attached to the third resonator $IC_3$, and the second electrode C2*b* of the capacitor $C_6$ attached to for the third resonator $1C_3$ is connected by the wire conductor lc through the opening $h_3$ to the second electrode C1*b* of the capacitor $C_7$ for the fourth resonator $1C_3$, while the second electrode C2*b* of the capacitor $C_8$ attached to for the fourth resonator $1C_4$ is connected by the wire conductor $l_2$ to a central terminal Toc of an output coaxial connector To provided at the right side of the casing H. On the upper side of the casing H corresponding to the upper, open ends of the bores Ho1 to Ho4, a cover plate U is secured to the casing H, for example, by securing screws (not shown), for closing said bores and for shielding the above described elements housed in the casing H.

In the connections as described above, the wire conductors $l_1$, la, lb, lc and $l_2$ may either be soldered, bonded with electrically conductive adhesive, or welded to the corresponding electrodes of the capacitors $C_1$ to $C_8$ and to the central terminals Tic and Toc of the input and output coaxial connectors Ti and To.

It should be noted here that in the embodiment of FIG. 8, although the present invention is mainly described with reference to the electrical filter FA employing the coaxial resonators 1C of FIG. 4 with the coupling capacitors mounted in the manner shown in FIG. 5, the kinds of the resonators, configurations of the terminal electrodes and arrangements for mounting the coupling capacitors may be modified in various ways, and for example, the resonators 1C may be replaced by the resonator 1 or 1B of FIG. 2 or 3, while the coupling capacitor mounting arrangement may also be replaced by that described with reference to FIG. 6. It is needless to say that the number of the resonators employed in the electrical filter FA may be decreased or increased depending on the necessity.

It should also be noted that in the filter FA of FIG. 8, if the resonator having the resonant frequency adjusting arrangement described with reference to FIG. 7 is employed, adjustment of the central frequency can be readily effected even after completion of assembly of the electrical filter.

As is seen from the foregoing description, by the arrangement of FIG. 8, compact electrical filters simple in construction and accurate in functioning can advantageously be manufactured at low cost.

Figure 9:
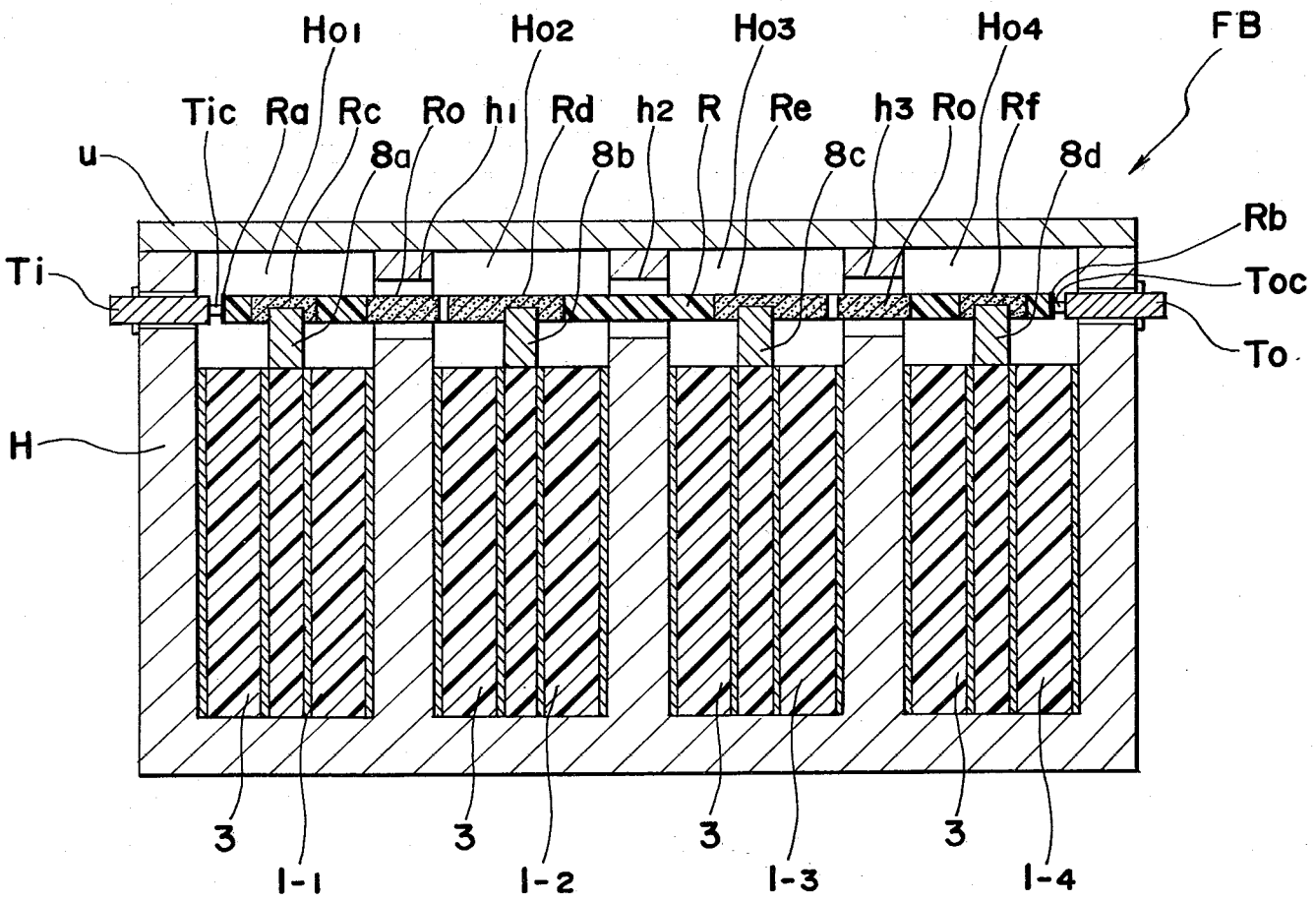
FIG. 9 is a view similar to FIG. 8, but particularly showing a modification thereof.
Figure 10:
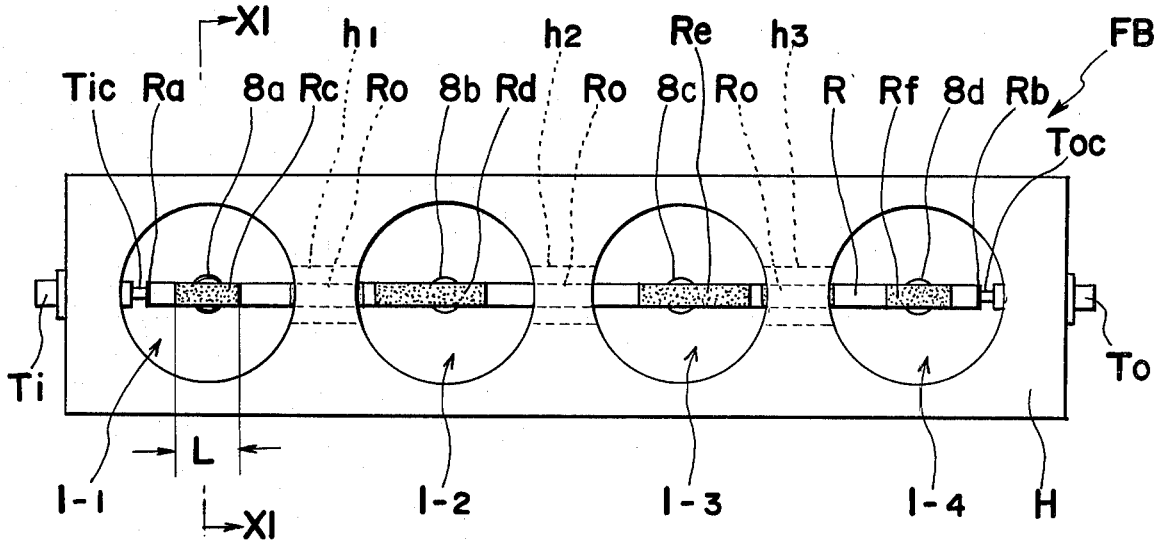
FIG. 10 is a top plan view of the filter of FIG. 9, with the upper cover of the casing removed for clarity, FIG. 11(*a*) is a cross-sectional view taken along the line XI—XI of FIG. 10, FIG. 11(*b*) is a view similar to FIG. 11(*a*), but particularly showing a modification thereof.
Figure 11A:
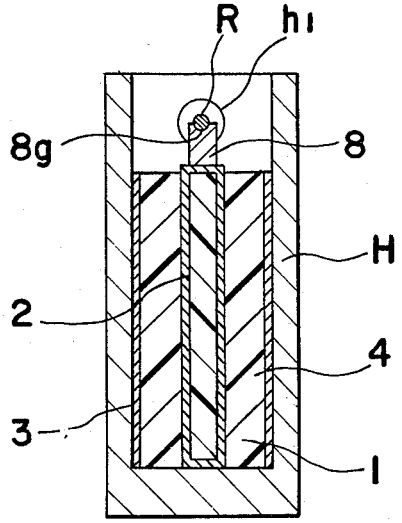
Figure 11B:
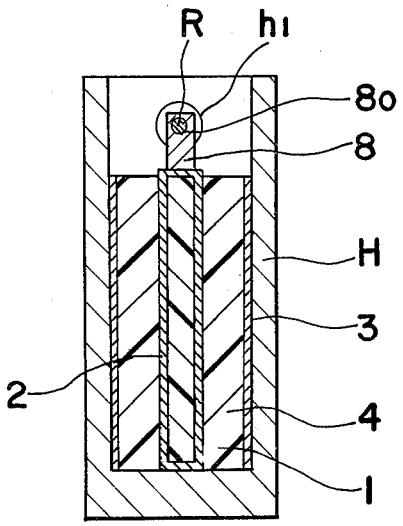

Referring now to FIGS. 9 to 11(*b*), there is shown a modification of the electrical filter FA of FIG. 8. In the modified electrical filter FB of FIGS. 9 to 11(*b*), the resonators $1C_1$, $1C_2$, $1C_3$ and $1C_4$ described as employed in the arrangement of FIG. 8 are replaced by the resonators I-1, I-2, I-3 and I-4 each having the structure earlier described with reference to FIG. 2, and the capacitors $C_1$ and $C_8$ employed with the resonators $1C_1$ to $1C_4$ and the wire conductors $l_1$, la, lb, lc and $l_2$ used in the electrical filter FA of FIG. 8 are also replaced by one dielectric rod R, which is coupled to the resonators I-1 to I-4 and input and output coaxial connectors Ti and To in the manner as described hereinbelow.

In the arrangement of FIGS. 9 and 10, the central terminals or conductors Tic and Toc of the input and output coaxial connectors Ti and To are connected to each other by the dielectric rod R, for example, of ceramic porcelain or the like. More specifically, the dielectric rod R has terminal electrodes Ra and Rb respectively provided at opposite ends thereof, and coupling electrodes Rc, Rd, Re and Rf formed on the rod R at predetermined intervals, for example, by baking silver paste onto the rod R in positions corresponding to the terminal electrodes 8 of the resonators I-1 to I-4. The dielectric rod R having the electrodes Ra to Rf thus formed thereon extends through the openings $h_1$, $h_2$ and $h_3$ formed in the walls of the casing H between the cavities $Ho_1$ and $Ho_2$, between $Ho_2$ and $Ho_3$, and between $Ho_3$ and $Ho_4$. The terminal electrode Ra of the rod R is connected to the central conductor Tic of the input electrode Ti, the coupling electrode Rc to the terminal 8*a* of the first resonator I-1, the coupling electrode Rd to the terminal 8*b* of the second resonator I-2, the coupling electrode Re to the terminal 8*c* of the third resonator I-3, and the coupling electrode Rf to the terminal 8*d* of the fourth resonator I-4. The other terminal electrode Rb of the dielectric rod R is connected to the central conductor Toc of the output coaxial connector To. In FIGS. 11(*a*) and 11(*b*), there are shown connections between the coupling electrodes Rc, Rd, Re and Rf of the dielectric rod R and the corresponding terminal electrodes 8*a*–8*d* of the resonators I-1 to I-4. In the arrangement of FIG. 11(*a*), there is provided a groove 8*g* of semi-circular cross section in the upper surface of each of the terminal electrodes or terminal portions 8*a*–8*d* of the resonators I-1 to I-4 for receiving therein the corresponding coupling electrodes Rc, Rd, Re or Rf of the rod R. Meanwhile, in the modification in FIG. 11(*b*), the groove 8*g* of FIG. 11(*a*) is replaced by a hole 8*o* formed at the upper portion of each of the terminal electrodes 8*a*–8*d* to accommodate the rod R. It is needless to say that the arrangement for connection between the coupling electrodes Rc to Rf of the rod R and the terminal electrodes 8*a*–8*d* of the resonators are not limited to those described with reference to FIGS. 11(*a*) to 11(*b*), but may be modified in various ways provided perfect coupling between the electrode Rcs to Rf and the terminal electrodes 8*a*–8*d*.

The degree of coupling between the resonators I-1 to I-4 is determined by the length L of each of the coupling electrodes Rc, Rd, Re and Rf, and the capacitance (effective capacitance) Cij between the neighboring coupling electrodes i and j is represented by the following equations:

$$Cij = \frac{\text{Cot}\,\frac{\pi}{2}\,(1 - kij)}{2\omega Zo}$$

(in the case where the resonators are of $\frac{1}{4}$ wavelength type)

$$Cij = -\tan \pi(1\text{-}kij)/2\omega Zo$$

(in the case where the resonators are of $\frac{1}{2}$ wavelength type) where $kij = W/\sqrt{gi \cdot gj}$, $W = \Delta f/fo$, g is the element of an original shape low-pass filter, fo is the central frequency, and $\Delta f$ is the bandwidth.

Figure 12:
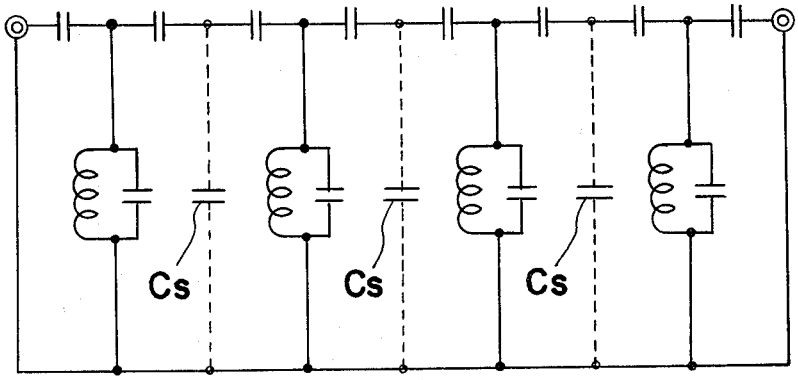
FIG. 12 is an electrical circuit diagram showing an equivalent circuit for the electrical filter of the invention.

Referring to FIG. 12, there is shown an equivalent circuit for the arrangement of FIGS. 9 to 11(*b*). In FIG. 12, the effective capacitance may be varied through variation of stray, capacitance Cs, and consequently, the coupling factor can be controlled by the stray capacitance Cs. The stray capacitance Cs can be varied by changing the diameters of the openings $h_1$, $h_2$ and $h_3$ or by forming electrodes Ro through baking of silver paste or the like onto the dielectric rod R in positions, for example, corresponding to the openings $h_1$ and $h_3$.

It should be noted that the upper cover U for the casing H in the foregoing embodiments of FIGS. 8 and 9 need not be of metallic material, but may be modified to be made of plastic material having a shielding effect.

Since other construction and effects of the electrical filter FB of FIGS. 9 to 12 are similar to those of the electrical filter FA of FIG. 8, detailed description thereof is abbreviated for brevity.

It should also be noted that although in the foregoing embodiments, the present invention is mainly described with reference to electrical filters to be inserted into coaxial electrical paths, the concept of the present invention is not limited in its application only to such coaxial electrical paths, but may readily be applicable to waveguides and strip lines as well, if a proper conversion circuit arrangement is added.

As is clear from the foregoing description, according to the arrangement of FIGS. 9 to 12, the electrical filter of the present invention includes at least two coaxial TEM resonators each having the dielectric member disposed between the inner and outer conductors and the terminal electrode provided in the inner conductor to project from the open end of the resonator, and the dielectric rod member which connects the input coaxial connector with the output coaxial connector and on which at least two coupling electrodes are provided at predetermined intervals for connection with each of said terminal electrodes, by which arrangement compact electrical filters simple in construction and which fulfill to the design goals are advantageously provided at low cost.

Although the present invention has been fully described by way of example with reference to the accompanying drawings, it is to be noted that various changes and modifications will now be apparent to those skilled in the art. Therefore, unless otherwise such changes and modifications depart from the scope of the present invention as limited solely by the appended claims, they should be construed as included therein.

What is claimed is:

1. An electrical filter, comprising:

an electrically conductive housing means;

at least two resonator means accommodated in and electrically connected and mechanically secured to said housing means, each of said resonator means comprising a dielectric member having a bore therein, an outer conductor member disposed on the outer periphery of said dielectric member and electrically connected to said housing means, an inner conductor member disposed on the periphery of said bore of said dielectric member, and a terminal electrode member secured to and in direct electrical contact with said inner conductor member, one portion of said terminal electrode means projecting from one end of said resonator means;

an input means for applying electrical signals to said electrical filter;

an output means for removing electrical signals from said electrical filter;

coupling means for electrically coupling said resonator means to each other at their respective ones of said terminal portions and also to said input and output connector means, said resonator means being so accommodated in said housing means that said terminal electrode members are disposed collinearly with each other and with said input and output connector means; and said coupling means comprising a dielectric rod member connected between said input and output means and a plurality of coupling electrodes corresponding in number to said resonator means, said coupling electrodes being provided on said dielectric rod member at spaced intervals such that each coupling electrode forms an electrical connection with a respective one of said terminal portions of said resonator means.

2. An electrical filter as claimed in claim 1, wherein each of said resonator means is accommodated in a respective cavity in said housing means; said cavities being in spaced and parallel relation to each other; openings being formed in said housing means between each pair of adjacent ones of said cavities, whereby the respective interiors of all of said cavities communicate; said openings being located collinearly; said dielectric rod member being accommodated in said cavities and said openings and having separate electrodes formed thereon in positions corresponding to said openings to determine stray capacitance, for controlling the effective capacitance between said coupling electrodes and, consequently, the coupling factor.

3. An electrical filter as claimed in claim 1, wherein each of said resonator means is accommodated in a respective cavity in said housing means; said cavities being in spaced and parallel relation to each other; openings being formed in said housing means between each pair of adjacent ones of said cavities, whereby the respective interiors of all of said cavities communicate; said openings being located collinearly; said dielectric rod member being accommodated in said openings and said cavities; the diameter of said openings being selected to determine stray capacitance, for controlling the effective capacitance between said coupling electrodes and, consequently, the coupling factor.

4. An electrical filter as claimed in claim 1, wherein said terminal portions projecting from said one end of said resonator means are further provided with means for adjusting resonant frequency of said resonator means, said means comprising a threaded aperture in each of said terminal portions and a screw disposed in each of said apertures.

* * * * *